US005611268A

United States Patent [19]

Hamilton

[11] Patent Number: 5,611,268

[45] Date of Patent: Mar. 18, 1997

[54] COMPACTOR WITH EXPANDING AND CONTRACTING NOZZLE

[76] Inventor: Robin Hamilton, Greenbanks, Long Lane, Dalbury Lees, Derby, United Kingdom, DE6 5B7

[21] Appl. No.: 406,870

[22] PCT Filed: Sep. 23, 1993

[86] PCT No.: PCT/GB93/01995

§ 371 Date: Jun. 9, 1995

§ 102(e) Date: Jun. 9, 1995

[87] PCT Pub. No.: WO94/07688

PCT Pub. Date: Apr. 14, 1994

[30] Foreign Application Priority Data

| | | | |
|---|---|---|---|
| Sep. 26, 1992 | [GB] | United Kingdom | 9220382 |
| Mar. 29, 1993 | [GB] | United Kingdom | 9306462 |

[51] Int. Cl.[6] ..... B30B 15/14; B30B 3/00

[52] U.S. Cl. ..... 100/50; 100/147

[58] Field of Search ..... 100/145–150, 100/50, 52

[56] References Cited

U.S. PATENT DOCUMENTS

| | | | |
|---|---|---|---|
| 3,065,689 | 11/1962 | Gueytron | 100/148 |
| 3,717,978 | 2/1973 | Osborne, Jr. | 55/289 |
| 3,876,548 | 4/1975 | Welles, Jr. | 210/391 |
| 3,913,307 | 10/1975 | Cardinal, Jr. | 56/328 R |
| 3,973,922 | 8/1976 | Williams | 100/147 |
| 3,991,668 | 11/1976 | De Milt et al. | 100/147 |
| 4,019,219 | 4/1977 | Willenborg | 15/339 |
| 4,109,341 | 8/1978 | Larsen et al. | 15/340.1 |
| 4,211,164 | 7/1980 | Fichtl et al. | 100/145 |
| 4,256,035 | 3/1981 | Neufeldt | 100/149 |
| 4,257,728 | 3/1981 | Schmidt et al. | 414/468 |
| 4,294,596 | 10/1981 | Taverez | 55/242 |
| 4,300,261 | 11/1981 | Woodward et al. | 15/345 |
| 4,395,794 | 8/1983 | Duncan | 15/340.1 |
| 4,561,145 | 12/1985 | Latham | 15/346 |
| 4,594,749 | 6/1986 | Waterman | 15/345 |
| 4,858,270 | 8/1989 | Boschung | 15/328 |
| 4,884,315 | 12/1989 | Ehnert | 15/346 |
| 4,897,194 | 1/1990 | Olson | 100/147 |
| 5,013,343 | 5/1991 | Miyamoto | 55/395 |
| 5,114,331 | 5/1992 | Umehara et al. | 425/200 |
| 5,337,658 | 8/1994 | Bruke | 100/148 |
| 5,452,492 | 9/1995 | Hamilton | 15/340.1 |

FOREIGN PATENT DOCUMENTS

| | | | |
|---|---|---|---|
| 2022470 | 2/1991 | Canada . | |
| 2022365 | 2/1991 | Canada . | |
| 3806 | 9/1979 | European Pat. Off. . | |
| 19538 | 11/1980 | European Pat. Off. . | |
| 0131063 | 1/1985 | European Pat. Off. . | |
| 0288436 | 10/1988 | European Pat. Off. . | |
| 0331432 | 9/1989 | European Pat. Off. . | |
| 0342504 | 11/1989 | European Pat. Off. . | |
| 0451134 | 10/1991 | European Pat. Off. . | |
| 0301000 | 10/1991 | European Pat. Off. . | |
| 526818 | 10/1921 | France | 100/145 |
| 2296051 | 7/1976 | France . | |
| 101024 | 1/1899 | Germany | 100/148 |
| 742026 | 10/1943 | Germany . | |
| 2007630 | 8/1971 | Germany | 15/346 |
| 2359200 | 6/1975 | Germany . | |
| 3010441 | 9/1981 | Germany . | |
| 3441145 | 5/1986 | Germany . | |
| 3831528 | 3/1990 | Germany . | |
| 60-234797 | 11/1985 | Japan | 100/145 |
| 153288 | 5/1977 | Netherlands . | |
| 364803 | 11/1962 | Switzerland . | |
| 613735 | 10/1979 | Switzerland . | |
| 277028 | 12/1927 | United Kingdom . | |
| 545991 | 6/1942 | United Kingdom . | |

(List continued on next page.)

*Primary Examiner*—Stephen F. Gerrity
*Attorney, Agent, or Firm*—Chilton, Alix & Van Kirk

[57] ABSTRACT

A compaction apparatus (2) has a screw conveyor (4) for conveying waste material through a passage (6) and compacting it therein. An exit nozzle (10) is arranged to communicate with the passage (6). The nozzle (10) defines a duct which enlarges and contracts response to increasing and decreasing material pressure, respectively.

19 Claims, 7 Drawing Sheets

FOREIGN PATENT DOCUMENTS

| | | |
|---|---|---|
| 579529 | 8/1946 | United Kingdom . |
| 1184795 | 3/1970 | United Kingdom . |
| 1202831 | 8/1970 | United Kingdom . |
| 1243999 | 8/1971 | United Kingdom . |
| 1387003 | 3/1975 | United Kingdom . |
| 1483664 | 8/1977 | United Kingdom . |
| 2034591 | 6/1980 | United Kingdom . |
| 1601846 | 11/1981 | United Kingdom . |
| 2132063 | 7/1984 | United Kingdom . |
| 2142961 | 1/1985 | United Kingdom . |
| 2159093 | 11/1985 | United Kingdom . |
| 2201447 | 9/1988 | United Kingdom . |
| 2211227 | 6/1989 | United Kingdom . |
| 2234328 | 1/1991 | United Kingdom . |
| 2241524 | 9/1991 | United Kingdom . |
| 82/01115 | 4/1982 | WIPO . |
| 87/05619 | 9/1987 | WIPO . |

III
III
2
66
62
60
69
80
83
82
70
225
74
72
71
88
90
92
220
16
8
100
36
46
200
58
48
56
54
52
10
41
30
38
20
63
6
4
40
22
12
24
24
22
63
20

FIG. 10
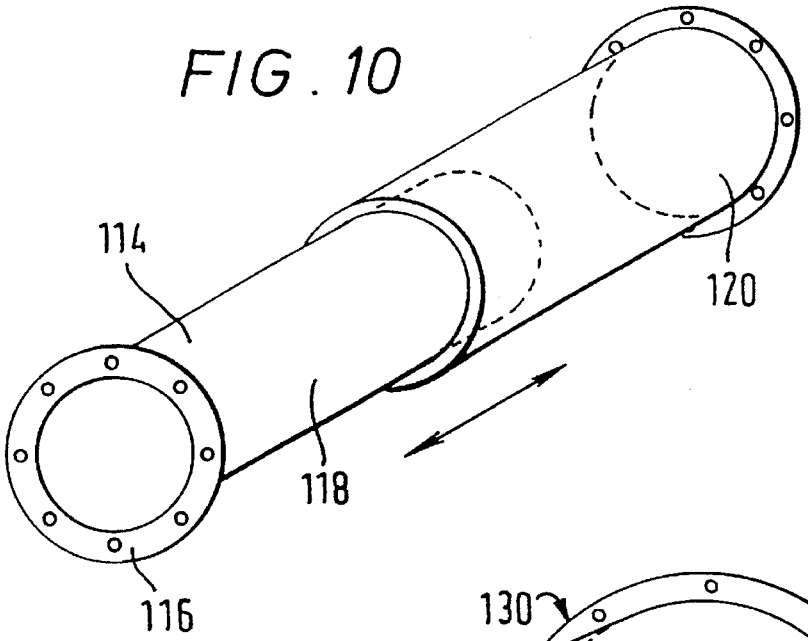
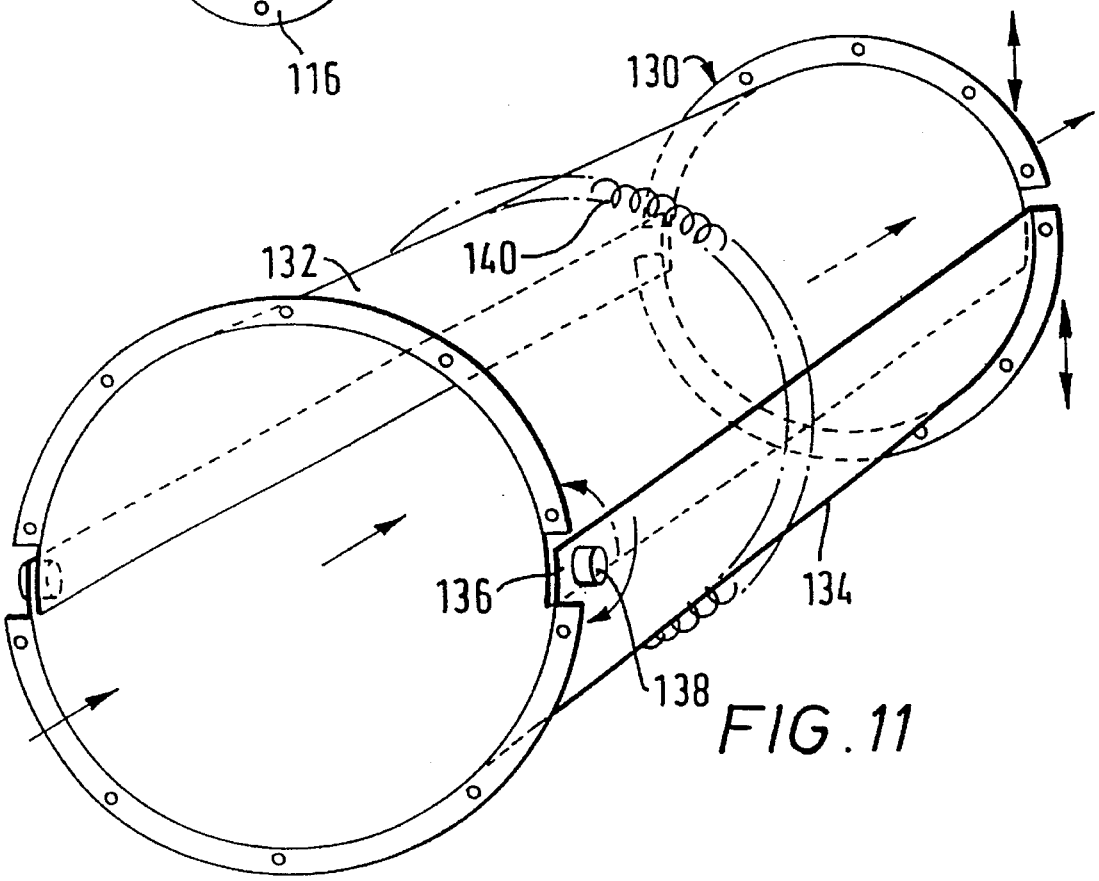
FIG. 11

COMPACTOR WITH EXPANDING AND CONTRACTING NOZZLE

BACKGROUND OF THE INVENTION

1. Field of the Invention

The present invention relates to compaction methods and compaction apparatus and in particular but not exclusively to methods and apparatus for compacting (i.e. compressing) waste material. Other applications for the invention include the compaction of materials used in farming and the food industry. These are not necessarily waste materials.

2. Description of the Related Art

Various types of material, including waste material such as litter and discarded packaging material, are bulky but not heavy. It is therefore desirable in certain circumstances to compact this material to reduce its volume in order to reduce transport costs or the storage space required.

Compacting apparatus is known which has conveying means operable to convey material along a path, which material is compacted as it moves along the path. Thus, the conveying means is arranged so that the density of material passing through the conveyor is relatively low at the beginning of the path and relatively high at the end of the path.

Such compaction can be achieved by using a screw conveyor located in a passage. Screw conveyors of constant pitch are generally used but in some arrangements a screw conveyor having a pitch which is relatively large at the beginning of the path and relatively small at the end of the path is used.

These known apparatus sometimes include a tapered portion near or at the discharge end of the path for further compaction. The cross-sectional area is thus relatively large at the entry to the tapered portion and relatively small at the exit thereof.

However, the known apparatus suffer from the problem that optimal performance can only be achieved for one set of operation conditions such as temperature, volume of waste fed into compactor and type and density of waste material. As will be appreciated, most waste compactors would in practice be exposed to a range of values for each condition. For example, a waste compactor which is situated outdoors would be subjected to the extremes of summer and winter temperatures. Likewise the uniformity of volume and type of waste cannot be guaranteed. For example an increase in the percentage of fatty or oily substances in the waste material can have an adverse effect on the performance of the compactor. Indeed in experiments carried out, the compaction achieved dramatically decreases especially for very slippery materials. The inability to deal with changes in conditions means that compactors will at one extreme not always compact material to the desired degree if at all and, at the other extreme, will have a tendency to jam.

Prior art is known which attempts to address at least certain aspects of this problem. For example, a resiliently biased trap door can be provided at the end of the conveying means which opens only when the pressure on the door exceeds a certain value. In theory, this allows waste material to accumulate so that variations in the volume of waste material do not affect the performance of the compactor. However, in practice, such doors remain partially open most of the time which leads to unsatisfactory results since maximum compaction is not achieved. Furthermore trap doors exert a sidways force which tends to encourage the break up of the compacted waste material which in turn can cause difficulties with the packaging and/or disposal of the material as well as increasing the volume of the compacted waste. In any case such compactors are not suited to applications requiring a relatively high degree of compaction as provided in accordance with embodiments of this invention.

Another problem from which the prior art compactors suffer is that the screw conveyor is generally very heavy in order to be sufficiently heavy duty to compress and compact waste or other material without itself being damaged. In particular, the thickness of the screw conveyor flight is dictated by the maximum force to which any part of the flight is subjected. The weight of the screw conveyor can lead to problems with providing sufficient support therefor.

Another problem associated with the weight of the screw conveyor concerns the provision of sufficient support for the conveyor. In the prior art, such screw conveyors are usually supported by fixed bearings at one end of the screw conveyor so that the longitudinal axis of the conveyor is immovable. The weight of the screw conveyor requires that the bearings be large and support the screw conveyor along a significant proportion of the length thereof. A mechanical bearing cannot be successfully used to support the outlet end of the screw conveyor since this would partially block the compactor outlet and interfere with the flow of compacted material which is of course undesirable.

Yet another problem with known screw conveyors is that they have a tendency to jam when a relatively incompressible object is fed into the conveyor. Under such circumstances, known screw conveyors attempt to continue to rotate with the motor applying an increased torque. This puts a strain on the motor and often is not sufficient to unjam the apparatus. The apparatus then will require manual attention to remove the blockage.

SUMMARY OF THE INVENTION

It has been found by the inventor that the problems with the prior art arise primarily from the outlet nozzle of the known apparatus being of rigid construction and having a constant volume. Whilst the shape and dimensions of the nozzle can initially be selected so that the apparatus is able to give good performance i.e. it is "tuned" for a given set of conditions, there is no flexibility in the apparatus. The inventor has found that an important factor in achieving successful compaction lies in the outlet nozzle providing an appropriate degree of back pressure. This back pressure enhances the compacting action and effectively tunes the apparatus. It is the loss or reduction of this back pressure which causes the performance of the known apparatus to deteriorate. Conversely, a substantial increase in back pressure can cause the apparatus to jam.

According to one aspect of the invention, there is provided compacting apparatus comprising a screw conveyor for conveying waste material through a passage and compacting it therein, and an exit nozzle communicating with the passage, said nozzle defining an internal transverse cross-sectional area which enlarges and reduces respectively in response to increasing and decreasing material pressure.

By altering the size of the outlet opening defined by the internal transverse cross-sectional area of the nozzle automatically in response to the volume and/or pressure of material flowing therethrough, the nozzle is able to compensate for changes in various conditions and ensure that an appropriate back pressure is achieved for a range of operating conditions. The compactor can thus effectively selftune in response to the nature and volume of waste passing therethrough. Embodiments of the invention may achieve a degree of compaction which is very much larger than that achieved by known prior art arrangements e.g. a 300–400% increase.

Thus for a greater range of operating conditions as compared with the prior art, the back pressure will remain above a predetermined minimum for satisfactory operation, and, conversely, excessive back pressures which might cause jamming of the screw conveyor can be avoided. This is achieved far more effectively in accordance with the invention as compared with a trap door outlet arrangement and without a sideways force being exerted on the waste or other material being compacted.

The ability of the apparatus to respond to changes in pressure in this way solves another problem from which prior art compactors tend to suffer. As material is compacted it is heated up. If the material remains in the nozzle for any length of time, for example whilst the compactor is not in use, the heated material has a tendency to solidify and/or adhere to the walls of the nozzle. The nozzle can thus become blocked and the apparatus then needs to be dismantled to remove the blockage. It has been found that since the cross-sectional area of the nozzle is able to change, at least in preferred embodiments of the present invention there is a self-cleaning and self-clearing effect which has been found to stop or reduce the tendency of material to stick to the nozzle walls.

It should be noted that references to a change in transverse cross-sectional area in the nozzle resulting in a change in the size of the outlet opening defined thereby can refer to changes occurring at substantially a single point, e.g. adjacent the nozzle outlet, or at all points along all or part of the length of the nozzle. The changes in cross-sectional area may be the same along all of the relevant part of the nozzle or, as is preferred, the transverse cross-sectional areas at different points along the length of the nozzle may change by different amounts. It is thus preferred that the nozzle tapers inwardly (in the flow direction) over at least part of its length and the changes in transverse cross-sectional area at all points along the tapered region arise from changes in the degree of taper. It is envisaged that the nozzle may taper outwardly in an extreme case e.g. to allow a hard plug of incompressible material to pass through. In a preferred such embodiment the nozzle is generally frusto-conical in shape and is adapted such that its cone angle decreases and increases in response to changes in pressure.

There are a number of ways in which the change in cross-sectional area in response to waste material pressure changes can be achieved. In one embodiment, the nozzle is formed of resilient material, or includes a resilient insert, which is biased inwardly toward a position of minimum internal cross-section. The resilient material responds to changes in pressure such that the nozzle opening widens as pressure increases to achieve the self tuning effect as described.

In an alternative preferred embodiment, the nozzle has a plurality of wall portions which are movable relative to each other to vary the internal cross-sectional area (i.e., the duct defined within the interior of the nozzle). These portions are preferably made of a hard wearing material such as steel which can withstand the abrasive forces applied by the waste material as it passes through the nozzle. For example the nozzle may comprise two semi-cylindrical portions which together define a generally cylindrical body having a degree of taper depending on the pressure in the nozzle. These two semi-cylindrical portions are hingedly connected together at the end region of the nozzle further from the nozzle outlet. So as to accommodate the change in internal transverse cross-sectional area of the nozzle along at least part of its length, the two cylindrical portions are preferably dimensioned so that one portion is slightly smaller than the other. Thus when required, parts of one portion can be received within parts of the other portion.

These portions may be biased using resilient means towards a position in which the transverse cross-sectional area is at its minimum value along the entire length of the portions. This may be a position in which the two semi-cylindrical portions define a cylinder of substantially uniform cross-sectional area. However, more preferably the semi-cylindrical portions define when biased to the minimum size of outlet opening, a tapered cylinder which tapers inwardly in the direction toward the end of the nozzle. As increased pressure occurs in the nozzle, the two semi-cylindrical portions are forced apart to thereby increase the internal cross-sectional area of the nozzle at all points along the length of the hinged portions.

The resilient means may take any suitable form and may be in the form of one or more springs extending around part or all of the circumference of the nozzle. Alternatively, the resilient means may be in the form of one or more elastic tensioning bands or a length of elastic material which is wound round part or all of the length of the nozzle. The resilient means may also take the form of an elastic sleeving. Of course, the resilient means may be provided at any suitable position along the length of the nozzle. The most effective position is, however, typically at the end region next to the nozzle outlet.

The nozzle preferably has at least one projection extending outwardly therefrom which retains the resilient means on the nozzle. This projection may take the form of a circumferentially extending lip or alternatively may take the form of one or more discrete projections extending from the nozzle. The at least one projection is arranged at any suitable location on the nozzle.

In another similar preferred embodiment, the nozzle comprises a larger number of longitudinally extending parts of e.g. steel or other suitably flexible hard wearing material. These relatively movable parts take the form of fingers extending generally longitudinally from an annular base part which may be secured around the screw conveyor outlet. The fingers are biased inwardly and are flexed relative to the base part to increase or decrease the internal cross-sectional area of the nozzle in response to changes in waste material pressure. When the fingers are at their innermost position, it is preferred that there are no gaps between the fingers and that the nozzle tapers toward its outlet. Thus, edge to edge abutment of the fingers can define the nozzle's innermost position. As the pressure in the nozzle increases and the cross-sectional area increases, V-shaped gaps are defined between the fingers. The fingers are biased toward their minimum position by resilient means which could take any of the above described forms.

The end or end regions of at least one and preferably all of the fingers may be provided with outward projections for retaining the resilient means in place. Of course the outward projections may be provided at any other suitable location on the nozzle.

It is particularly preferred that the nozzle comprises two members each of which takes the form previously described, ie. an annular base part having longitudinally extending fingers. One member is arranged inside the other. Consequently the cross-sectional dimensions of the outer member are greater than that of the inner member. It is also preferred that the fingers of the outer member are slightly longer than those of the inner member so that when the cross-sectional area of the nozzle is at its minimum, the fingers of the outer member cover the ends of the fingers of the inner member. The two members are preferably arranged so that a finger of one member overlaps two fingers of the other member (and the gap between the fingers when appropriate). Thus even when the fingers are in their most expanded state, the waste is fully contained by the overlapping fingers of the two members and cannot escape between the gaps of the fingers. Of course, outward projections for retaining the resilient means need only be provided on the outer member.

The preferred resilient biasing means exerts a very substantial radially inward force on the nozzle—resulting from tensioning bands that typically might number 20 to 30 exerting a circumferential tension typically of 250 kg per cm of axial length of the nozzle. In the absence of any compacted material within the nozzle to counter this force, the preferred form of nozzle might be damaged i.e. its fingers might be imploded inwardly beyond the intended minimum position defined by their edge to edge abutment. To avoid this, a preferred embodiment of the nozzle is initially fitted with a plug e.g. of polyurethane which supports it internally. The plug is ejected once compacted material is passed through the nozzle whereafter there will always be compacted material supporting the nozzle in normal use of the apparatus i.e. even when it is shut down a plug of material remains in the nozzle.

In an alternative embodiment, it is envisaged that the cross-section of the nozzle may be altered by a servo-controlled motor or the like. The nozzle may be made up of two or more parts, such as described above. The parts making up the nozzle may be moved by the motor under micro-processor control to change the cross-sectional area of the nozzle in response to pressure detected, for example at the outlet end of the screw conveyor. The nozzle opening may also open and close as a function of screw conveyor torque or drive motor current, both of which vary in dependence on pressure.

According to a second aspect of the present invention there is provided a screw conveyor in or for a waste compaction apparatus for conveying and compressing waste or other material, wherein said screw conveyor comprises a longitudinally extending shank and a flight, the thickness of the part of flight subjected to the greatest force in use being greater than the thickness of the other parts of the flight of the conveyor.

It has been found that the part of the flight nearest the outlet end of the conveyor tends to be subjected to the largest amount of pressure as a result of the extra force exerted by the compacted material. Typically, the flight will therefore have the greatest thickness at the outlet end of the conveyor with the thickness being least at the inlet end.

Thus with the embodiments of this aspect of the invention, the thickness of the flight need only be at the maximum required value at that part of the screw conveyor which is subjected to the greatest force. The other parts of the flight need not be so thick and accordingly the weight of the conveyor is reduced resulting in economies in manufacturing as well as running of the apparatus.

This arrangement is particularly suited to those cases where the force applied to the screw flight by the material does not increase linearly but rather increases more quickly, for example where the screw conveyor is tapered towards the outlet and is received in a correspondingly tapered passage and/or the pitch of the flight decreases toward the outlet end of the conveyor. In these cases, the force applied to the flight in the vicinity of the outlet can be very large and the additional thickness of the flight is able to compensate for this.

It is preferred that the flight has a relatively large diameter flight in the region where it takes up material i.e. beneath a hopper so that large discrete chunks of material and other bulky items can fall between the flights and be taken up by the conveyor. This then leads to an inwardly tapering portion in which compaction or at least pre-compaction of material takes place.

The thickness of the flight of the screw conveyor may increase uniformly from an inlet end to the outlet end of the conveyor. Alternatively, the thickness of the flight can be uniform along most of the length of the screw conveyor with a region of increased thickness provided only adjacent the outlet end of the screw conveyor. In a preferred embodiment, the thickness of the flight increases in a stepwise fashion from the inlet end to the outlet end of the conveyor with the first stepped increase preferably being at a point slightly upstream of an inwardly tapering portion of the flight. This last alternative is preferred as it allows full advantage to be taken of the invention whilst at the same time still allowing the device to be manufactured relatively easily.

According to a third aspect of the invention, there is provided compaction apparatus comprising a screw conveyor arranged in a conveying passage and rotatably supported in relation to the passage housing in the region of the inlet end of the conveyor, such support permitting a degree of transverse movement of the longitudinal axis of the conveyor in the region of its outlet end, wherein the conveyor comprises at its outlet end an axial shank extension which extends into a compaction chamber located downstream of the screw conveyor and coaxial therewith, the shank extension in use being surrounded by an annulus of compacted material in the downstream compaction chamber, such compacted material providing a support bearing means for the outlet end of the conveyor.

A fourth aspect of the invention provides a method of compacting waste or other material, comprising conveying material by a rotating screw conveyor, compacting the material in a compaction chamber located downstream of the screw conveyor, and supporting the outlet end of the screw conveyor during compaction by means of an annulus of compacted material which surrounds an axial shank extension of the screw conveyor projecting into the compaction chamber. The axial shank extension may comprise e.g. 10–30% of the total length of the screw conveyor.

Since the screw conveyor is, in effect, supported also at its free, outlet end during use of the apparatus, the bearing required at the inlet end of the conveyor need not be as strong as those required in the prior art. In a preferred embodiment the inlet end may be supported directly from a drive motor or gear box output shaft without the need for costly, heavy duty bearing means to provide additional support.

Since the support for the screw conveyor is improved in this aspect of the invention, a lesser clearance may be left between the outer edge of the flight and the inner walls of the chamber without the risk of the flight engaging the walls and being damaged. This improves performance particularly with slippery waste which has a tendency to recirculate through the apparatus by slipping past the outer periphery of the conveyor.

Preferably, the axes of the compaction chamber and conveying passage coincide such that when the shank extension is supported in use, the axis of the screw conveyor and the passage also coincide. Thus the waste support is able to centre the axis of the screw conveyor automatically. The waste material acts as a self-centring bearing for the free end of the screw conveyor which is able to compensate for wearing of the passage and/or the screw conveyor itself.

Preferably, the compaction chamber into which the shank extension extends is cylindrical and may form part of an exit nozzle of the apparatus which preferably also includes a tapering outlet part upstream of the compaction chamber. The tapering part may be as described in relation to the first aspect of the invention.

It is desirable that the inner walls of the passage may be formed so as to resist or prevent conveyed material from rotating about the axis of the passage. The inner wall of the passage may have at least one prominence or rib which is engageable with material in the passage. The or each prominence or rib is preferably adjustably mounted on the passage walls, to allow the degree of projection into the passage to be varied. The or each prominence or rib may be resiliently mounted. Whilst it is preferred that the or each prominence or rib extends longitudinally of the passage, the or each prominence or rib may extend along a helical path.

Such prominences or ribs have a tendency to damage the flight of the screw conveyor if allowed to contact them.

In order to safely transport the waste compactor, it is therefore preferred that the screw conveyor is received in a stocking of protective material such as suitable plastics so that the screw conveyor cannot move laterally in the passage to cause damage in transit. To remove this stocking, the compactor merely needs to be switched on. The action of the screw conveyor will cause the stocking to be ejected from the apparatus thereafter the compacted material keeps it centered. Alternatively or additionally, the nozzle plug discussed in relation to the first aspect of the invention may surround part of the screw conveyor to initially maintain its axial location.

Viewed from a fifth aspect, there is provided apparatus for compacting waste or other material comprising: a screw conveyor arranged in a passage; means for rotating said screw conveyor in a first, compacting and conveying direction; means for sensing a jammed condition of said conveyor; and a back chamber arranged at an input end region of the screw conveyor for receiving material causing said jamming, wherein, after a jammed condition has been sensed, said rotating means is arranged to rotate said screw conveyor in a second, opposite direction to the first direction and to move said jamming material to said back chamber.

This reversal of direction of rotation of the screw conveyor allows jamming material to be moved back into a back chamber where it no longer jams the apparatus and can be further dealt with, for example by being tumbled or removed, either manually or automatically, from the apparatus.

There are two main causes of jamming. The first is that incompressible lumps of material are too large to pass through the conveyor and have not been broken up by the previous action of the conveyor. This problem is exacerbated by conveyors which are tapered and/or which have decreasing pitch. The second cause of jamming is material reaching a compaction maximum and thus being unable to pass any further along the conveyor. Accordingly, in a particularly preferred embodiment, the back chamber has tumbling means which is arranged to attempt to break up the jamming material and/or reduce its density so that it can be processed through the compactor in the normal way when the screw conveyor is again driven in the first direction. The tumbling means preferably provides a cutting action.

The tumbling means can be of any suitable form and may be part of the screw conveyor itself which has been modified, for example, by sharpening the flight edges to provide a cutting edge. However, it has been found that a flexible part secured to the flight performs well. The flexible part might be used to mount a hard and rigid cutting member to the shank of the screw conveyor. The flexible part can be of any suitable material such as polyurethane and, if used, the cutting member may be formed of, for example, a metal such a steel. The blade can continue along the path defined by the flight of the screw conveyor. This blade has been found to encourage the break up of material but itself is not damaged by material which cannot easily be broken up, if at all. This is a consequence of the flexible part. The jamming material can then be tumbled in the back chamber by the rotation of the shaft in the reverse direction and the blade can attempt to break up or decrease the density of the jamming material. After a predetermined time, the screw conveyor is rotated in the forward direction in a further attempt to process the jamming material which initially jammed the compactor.

If the compactor jams again, it is preferred that the jamming object be returned to the back chamber where material is again tumbled. The cycle then repeats. After the machine has made any selected number of unsuccessful attempts to break up material returned to the back chamber, the material can be removed manually or automatically dropped into a trough below or behind the chamber from where it can be removed when a compaction cycle is completed. At this stage, a warning signal can be given and/or the apparatus can be shut down.

The chamber preferably has a cover which prevents waste material initially input into the compactor from entering the chamber. Preferably the cover is movable so as to allow access to the back chamber to remove objects therefrom, if necessary. The cover preferably directly engages the screw conveyor and is flexible so as not to be damaged on reversal of the screw conveyor.

Additionally, it is particularly preferred that when a jamming condition is initially sensed, the screw conveyor is reversed by for example only one or two revolutions and then the screw conveyor is again rotated in the forward direction. This step can be repeated any number of times and for example could be in the range of one to twenty attempts before the material is taken back to the back chamber and the above procedure followed.

Viewed from a still further aspect the invention provides a compacting apparatus comprising a rotating screw conveyor a part of which is located in a passage which tapers inwardly in the direction of movement of material being compacted, at least the tapering part of the passage being provided with longitudinally or helically extending ribs to help restrain the material from rotating with the conveyor, the apparatus being adapted to sense a jamming condition therein, whereupon the rotation of the conveyor is reversed by part of a turn or a small number of turns before being rotated in a forwards direction again, such cycle being repeated one or a predetermined number of times.

In practice we have discovered that with this arrangement most jamming conditions can in practice be cleared. Thus, in the preferred embodiment, the material is only taken into the back chamber in extremis, most blockages being able to be cleared by the initial reversal and retry procedure.

The sensing means may measure any suitable parameter such as the torque applied to the screw conveyor by the motor or the current fed to the motor (which is also a measurement of torque). The sensing means is arranged to sense jamming of the conveyor as it is rotated in the first, forwards direction and preferably also senses if jamming takes place whilst it is rotating in the second, reverse direction whereupon the direction of rotation is again reversed.

According to yet another aspect of the invention, there is provided a method of compacting e.g. waste comprising:

feeding waste material into a compacting screw conveyor;

rotating the screw conveyor in a first, forward direction to thereby compact and convey the waste material;

monitoring the apparatus for the occurrence of a jamming condition; and rotating the screw conveyor in a second, reverse direction after a jamming condition has been detected, through part of a turn or a small number of turns and then rotating in the first direction in an attempt to clear the jamming condition, and repeating this operation up to a predetermined maximum number of times if the jamming condition is not cleared; and after the predetermined number of attempts, reversing the rotation of the conveyor for a greater number of turns so as to move the material causing the jam to a chamber adjacent the end of the conveyor remote from the waste outlet.

All the above operations can be carried out under automatic or micro-processor control.

A completely separate aspect of the invention concerns drainage and lubrication. We have discovered that for optimum performance with waste material having a fluid component the fluid level in the base of the compactor should be controlled to provide a degree of self-lubrication whilst not being detrimental to the conveying and compacting action.

Thus, a still further aspect of the invention provides a compacting apparatus having a rotating screw conveyor located in a passage, wherein the passage comprises means to maintain a predetermined maximum fluid level in the base region of the passage.

Such means preferably comprises a fluid outlet at such level, advantageously in the form of a raised horizontal platform having a filtering means. Desirably part of the screw conveyor provides a wiping action on the filtering means. In a preferred embodiment, the outlet is provided in the back chamber described above and the tumbling means therein provides the wiping action.

As will be appreciated, compacting apparatus according to the invention can embody any one or more of the features described in relation to the various different aspects.

The following features may also be included in any embodiments of the invention. The screw conveyor may be received in a passage which has a portion of substantially uniform cross-sectional area located beneath a waste material inlet hopper and a tapered portion which is at the downstream end of the conveyor and tapers inwardly towards an outlet nozzle. The diameter of screw conveyor preferably reflects the size of the passage and accordingly is decreased in the tapered part. This tapering helps to increase the compaction in the passage.

Additionally or alternatively, the pitch of the screw conveyor may decrease toward the outlet of the passage so as to help obtain sufficient compaction. Thus the pitch could be relatively large at the beginning of the passage and relatively small at the end of the path. The pitch preferably decreases substantially continuously over whole or part of the length of path.

Of course, the tapering is not essential and sufficient compaction may be achieved in certain embodiments which have a screw conveyor passage of uniform cross-section. Likewise, the passage could be tapered along the whole of its length. Thus the cross-section of the passage may be relatively large at the entry to the passage and relatively small at the outlet. The cross-section may decrease substantially continuously along the whole or part of the length of the passage.

The exit nozzle preferably includes an inwardly tapering part connected to the passage via a cylindrical compaction chamber. Thus, in a preferred embodiment material is compacted as it is moved along by the screw conveyor, with further more substantial compaction taking place in the compaction chamber. In practice, in such an embodiment the greatest amount of compaction takes place immediately downstream of the screw conveyor.

Furthermore, the nozzle does not of course need to be connected directly to the outlet of the conveyor passage. For example, a second passage may be arranged between the outlet of the screw conveyor and the inlet of the nozzle. This second passage may be arranged so as to resist movement of material through that second passage, to further compact material received from the screw conveyor. The movement of material through this second passage is preferably resisted by friction between he material and the walls of he second passage. This resistance provided may be varied by for example changing the length of that passage and/or is cross-sectional area. In the former case, he second passage may be defined by two portions which may telescope together. In he latter case, the second passage may, for example, be formed in a manner described above in relation to he exit nozzle.

Waste compacting apparatus such as described is suitable both for fixed installations as we as for use in refuse collection vehicles. The particular use to which a waste compactor is put will depend to a certain extent on the actual dimensions and material of the conveyor and other parts of the compactor. For example, it has been found that the compactor is particularly useful for compacting the waste from restaurants and other similar installations. Compactors embodying the invention also have uses in industrial situations for compacting factory waste. It is also envisaged that waste compactors embodying the invention will also have applications in the home.

Whilst the invention has been described primarily in relation to the compaction of waste, embodiments of the invention can be used for other applications where compaction of a material is required. For example, embodiments of the invention can be used on farms or in factories to provide compaction of food products.

BRIEF DESCRIPTION OF THE DRAWINGS

Embodiments of the invention will now be described by way of example and the reference to the accompanying drawings in which:

FIG. 10 shows a schematic view of a back pressure chamber for use with the compactor of FIG. 1; and FIG. 11 shows a schematic view of a second embodiment of the nozzle.

DESCRIPTION OF THE PREFERRED EMBODIMENTS

Figures 1, 1A:
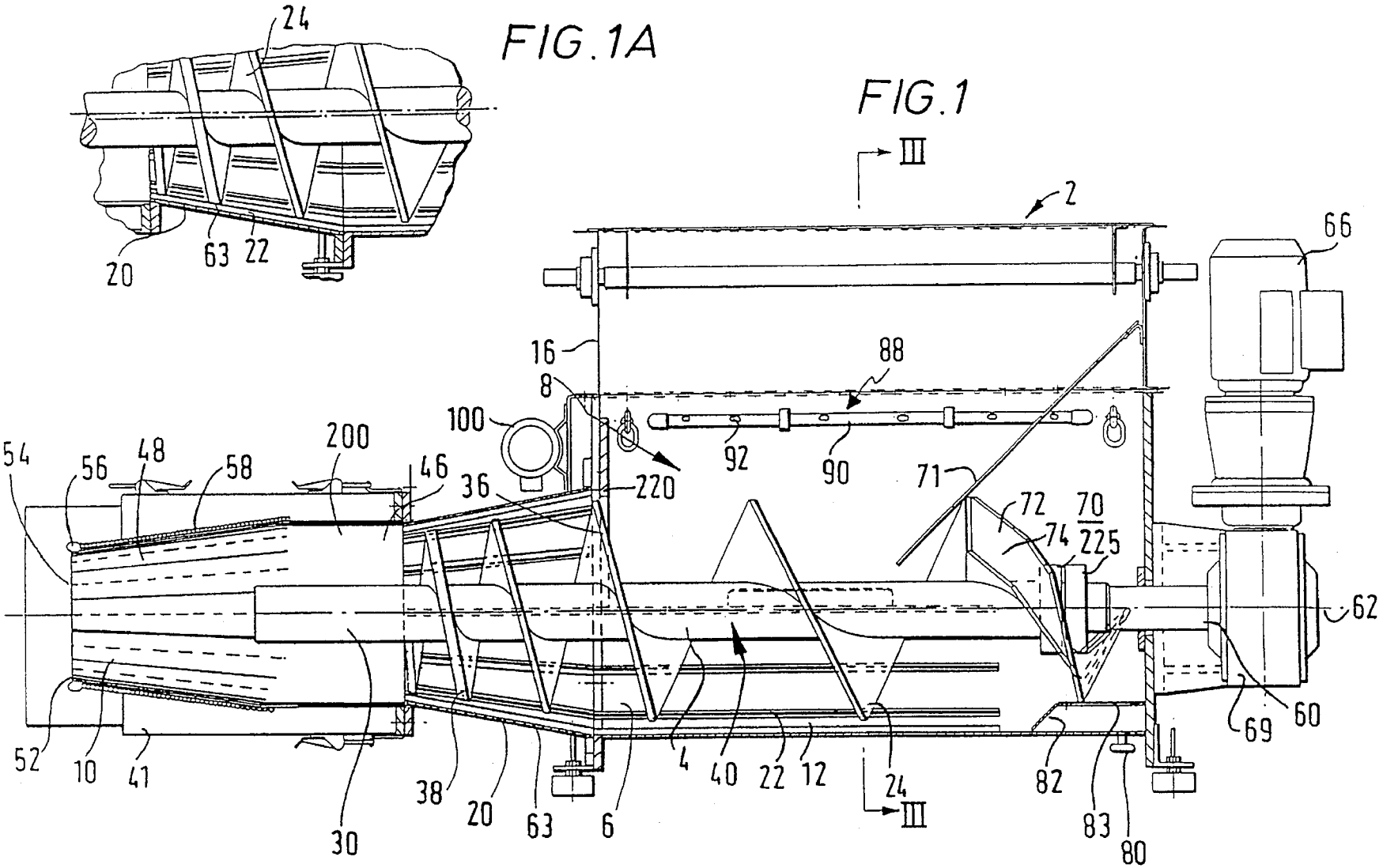
FIG. 1 shows a longitudinal cross sectional view of a compactor.
FIG. 1*a* shows an enlarged view of part of the compactor of FIG. 1.
Figure 2:
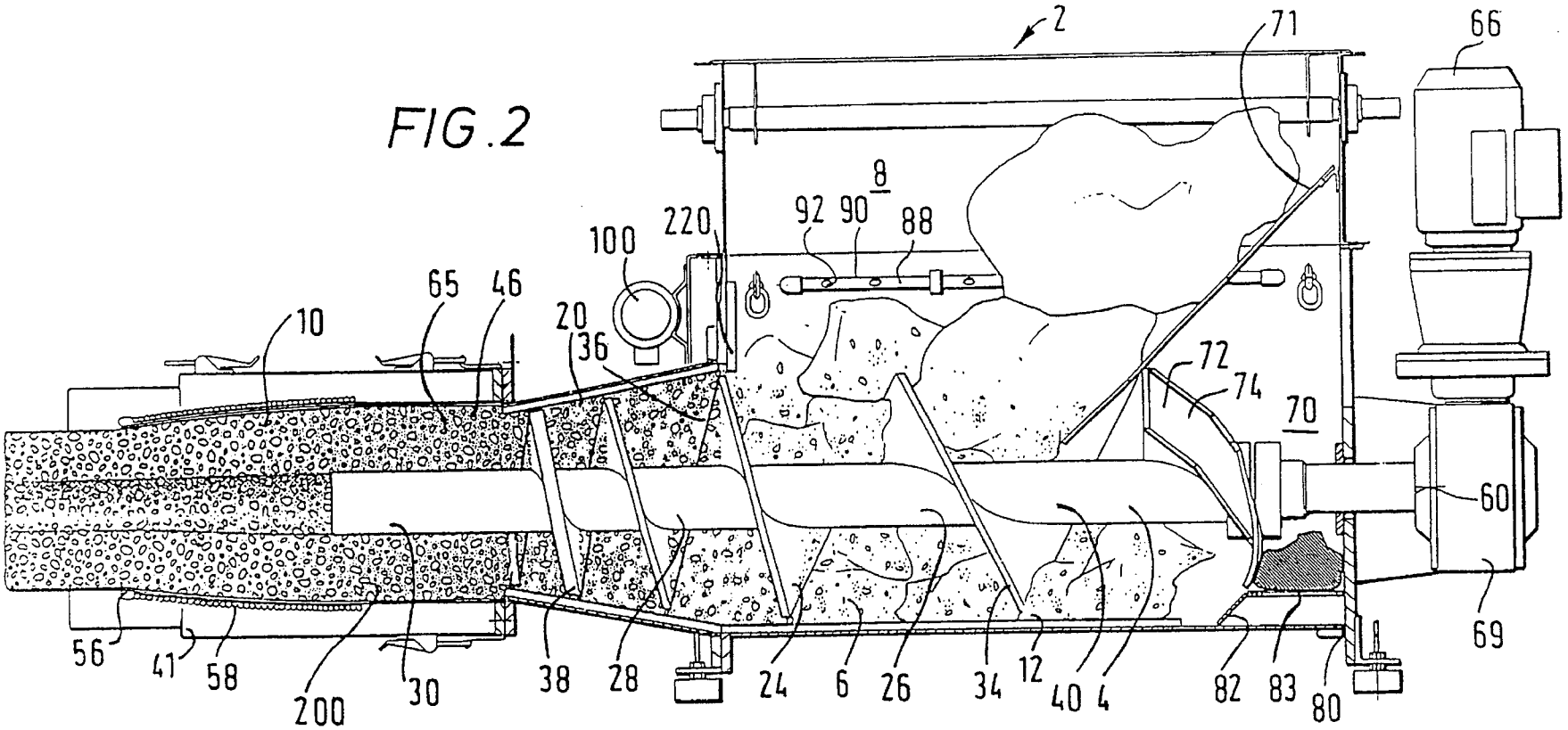
FIG. 2 shows a longitudinal cross sectional view of the compactor of FIG. 1 when filled with waste material.

As can be seen from FIG. 1 to 7, the waste compaction apparatus 2 has a screw conveyor 4 which conveys as well as compacts material along a passage 6 from an inlet 8 to an exit nozzle 10.

The passage 6 is generally cylindrical and has a first part 12 of generally uniform cross-section. The first part 12 of the passage has a longitudinally extending opening 14 through which uncompacted waste material is fed from hopper 16. The size of the hopper 16 is selected so as to prevent over filling of the apparatus. In practice, this first part 12 is in the form of a trough having a rounded bottom 18 (see FIG. 3), the sides of which also define the hopper 16. The trough opening defines the longitudinally extending opening 14.

The passage 6 also has a second part 20 which is tapered in the direction towards the exit nozzle. This second part 20 thus has a generally frusto-conical shape.

The inner walls of the passage 6, both in the first part 12 and the second part 20 are provided with longitudinal extending ribs 22 which project inwardly into the passage. These ribs 22 prevent partially compacted material from rotating with the screw conveyor 4. Where appropriate the ribs 22 are also able to provide a cutting surface or anvil against which the flight 24 of the screw conveyor 4 can act to break the waste material down into smaller pieces which are more easily compacted.

The inner walls of the first part 12 of the passage are provided with two projections 230 (see FIG. 3) which extend along its length. These two projections 230 are arranged to contact the outer periphery of the screw conveyor to cut up elongate waste material such as plastics bin liners and the like. This prevents such material from wrapping itself around the screw conveyor and causing it to jam. The projections 230 are provided with a cutting edge for this purpose. The outer periphery of the screw conveyor may also be provided with a sharpened edge to cut up the material.

Figure 7:
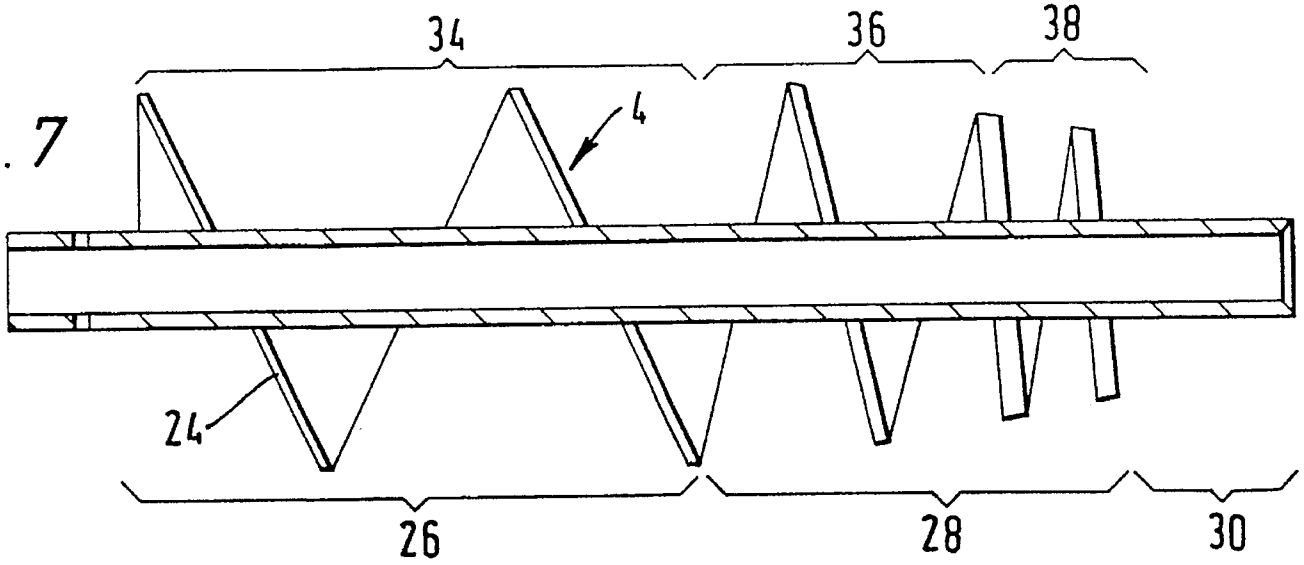
FIG. 7 shows a cross-sectional view of the screw conveyor of the compactor of FIG. 1.

The screw conveyor 4, which is illustrated in detail in FIG. 7 has a first part 26 where the flight is of uniform diameter. The length of this first part 26 corresponds substantially to the length of the first part 12 of the passage 6. The flight diameter of the second part 28 of the conveyor 4 decreases in a manner which corresponds generally to the degree of taper of part 20 of the passage 6. The diameter of the flight 24 of the screw conveyor is selected such that there is usually a few millimeters clearance between the screw conveyor 4 and the projecting ribs 22. Typically this clearance is in the range of 2 to 3 mm.

The screw conveyor 4 has a third part 30 in the form of a shank with no flight which extends into the nozzle 10. The purpose of this third part 30 will be described in more detail later.

The pitch of the screw conveyor 4 also varies along its length. In particular the pitch of flight 24 decreases in the direction towards the second tapered part 28. For example the first one and a half turns 34 have a pitch of 400 mm, the second one and a half turns 36 a pitch of 200 mm whilst the third one and a half turns 38 have a pitch of 100 mm ie. giving a pitch ratio of 4:2:1 along the length of the screw conveyor 4. The decrease in pitch of the screw conveyor 4 as well as the tapering of passage 6 enhances the degree of compaction achieved by the waste compaction apparatus 2. The pitch of the screw conveyor is of course selected depending on the material to be compacted usually as well the degree of compaction required.

The thickness of the flight 24 changes along the length of the screw conveyor 4 and, in particular, increases as the pitch decreases. In the specific embodiment, about the first one and a half turns 34 have a flight thickness of 12 mm, about the second one and a half turns 36 have a flight thickness of 20 mm whilst about the third one and a half turns 38 have a thickness of 25 mm. Thus, the part of the flight which is subjected to the greatest force as a result of the tapering passage and reduced pitch, has the greatest thickness to withstand that increased force and the resulting increase in wear. The life of the screw conveyor 4 is thus increased. Likewise, those parts of the conveyor which are subjected to least force have the smallest flight thickness. This results in a useful reduction in the weight of screw conveyor especially since the part 34 of the flight 24 having the least thickness has the largest diameter. In practice, the thickness preferably begins to increase slightly upstream of the tapering part 28, although this is not appreciable from the drawings.

The dimensions given in relation to pitch, flight thickness and flight diameter are included only for illustrative purposes and can be varied in accordance with the application and size of the apparatus.

The screw conveyor 4 is made from any suitable material which has the desired strength, rigidity and resistance to wear for the particular application in question. For example the screw conveyor 4 may be of mild steel. Furthermore the shank 40 of the screw conveyor 4 is hollow so as to further reduce the weight thereof.

The maximum initial compaction ratio achieved as a result of material passing through the screw conveyor 4 itself is determined by the ratio of the volume between the flight turns 34 below the longitudinal opening 14 to the volume between the flight turns 38 at the end of passage 6 adjacent the nozzle 10. In a preferred embodiment, this ratio may be between 4:1 and 10:1 which latter ratio in practice results in a compaction ratio of about 7 or 8:1. (Maximum compaction would in practice be not often achieved since the screw conveyor would not have the maximum volume of material required for maximum compaction passing through it at all times.) The required initial compaction depends on the type of waste being processed, and different screw conveyors may be supplied for different applications to provide optimum performance.

Figure 4:
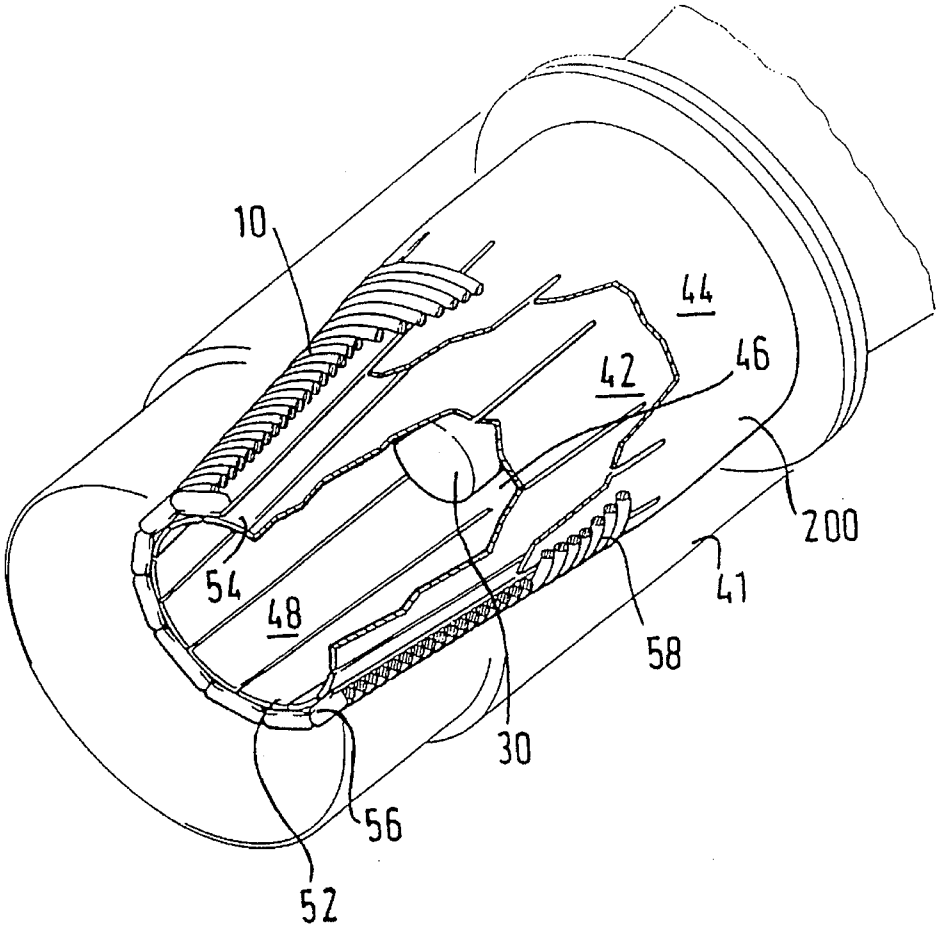
FIG. 4 shows a perspective view of the nozzle of FIG. 1 which has been partially cut away for clarity.
Figure 3:
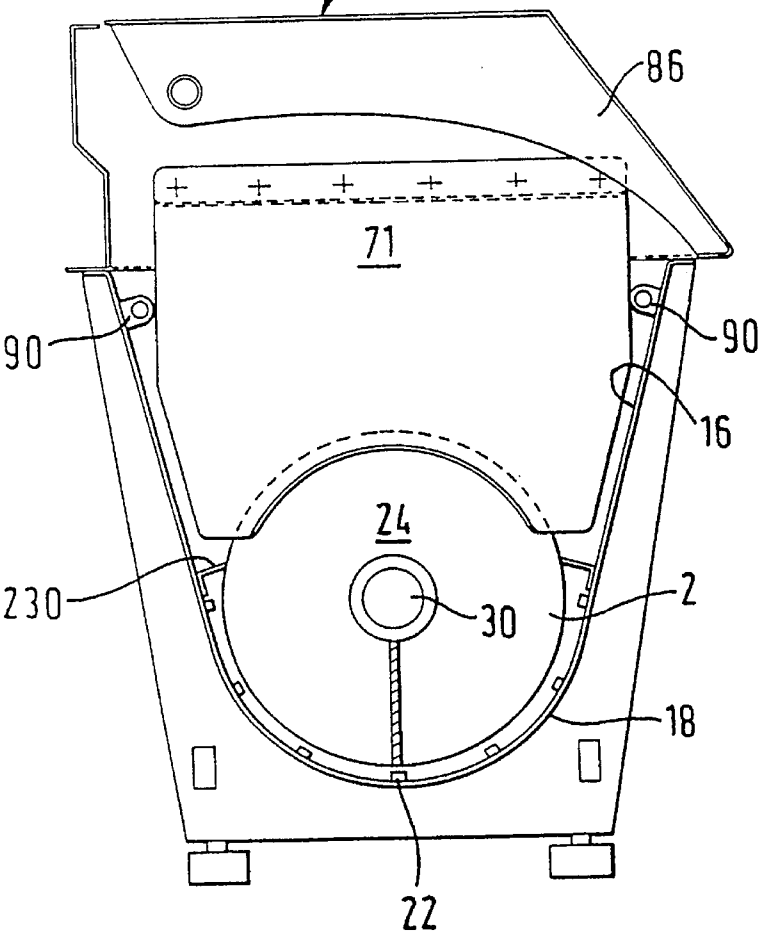
FIG. 3 shows a cross-section of the compactor of FIG. 1 along line III—III.
Figure 5:
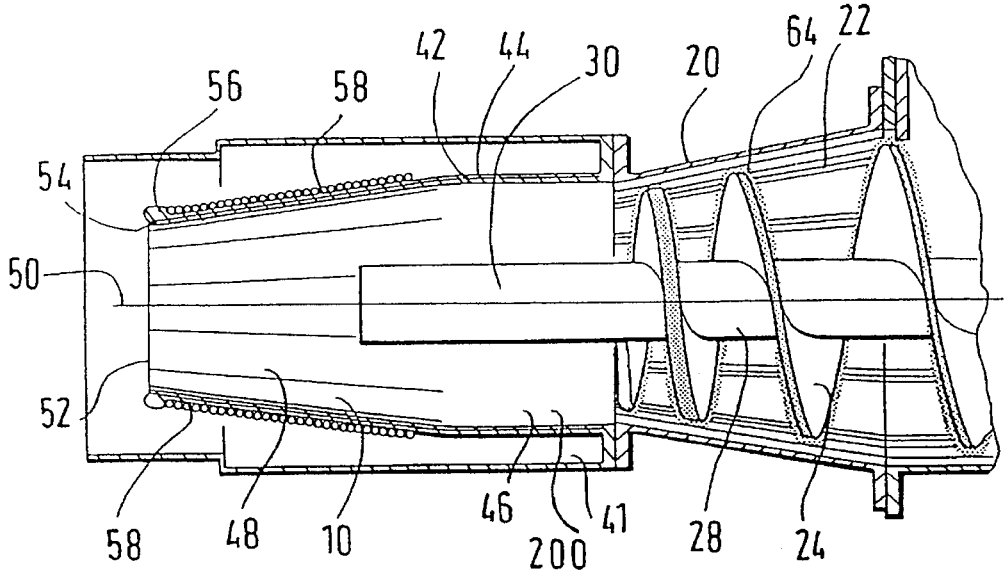
FIG. 5 shows a cross-sectional view of the output end the compactor of FIG. 1, with the screw conveyor packaged for transportation.

The nozzle 10 will now be described in more detail with particular reference to FIGS. 4, 5 and 6. The nozzle 10 is coupled to the outlet end of passage 6 at the end of section 20 and is surrounded by chamber 41 which allows any material leaking from the nozzle 10 to be collected in the chamber 41. The nozzle is made up of two main parts 42 and 44. The first part 42 is formed from a sheet of material such as sheet steel with a thickness of 2 to 3 mm which has been rolled up to form a cylinder and welded to maintain that shape. The base portion 46 of the first part 42, which is connected to the passageway 6, is circular, of substantially constant cross-section and of unbroken sheet material. This defines a compaction chamber 200 in which further substantial compaction of the waste material takes place upstream of the tapering portion of the nozzle. From this base portion 46 a plurality of eg. twelve fingers 48 extend, the axis of each finger initially being generally parallel to the longitudinal axis 50 of the nozzle 10. The width of each finger 48 decreases in the direction towards the outlet 52 of the nozzle 10 to thereby define V-shaped gaps (not shown) between adjacent fingers 48.

The second part 44 is constructed in a similar manner to the first part 42, the two parts differing only in dimensions. In particular the second part 44 is slightly longer than the first part 42 and has a slightly larger diameter. The first part 42 is arranged inside the second with the base portions 46 of the first and second parts 42 and 44 being welded together. The two parts 42 and 44 are arranged so that the fingers 48 of one part overlap the gaps between the fingers of the other part. ie. each finger of one part overlaps two fingers of the other part.

On the outer surface of the ends 54 of each of the fingers 48 of the second outer part 44, a lug 56 is provided. These lugs 56 extend in a generally outward direction. A number e.g. 20 to 30 of elastic tension bands 58 are then arranged around the nozzle, in the manner shown particularly clearly in FIG. 4. Alternatively, a length of elastic tensioning rope may be wound around the nozzle. The lugs 56 retain the bands 58 in position around the nozzle. The elastic tension bands 58 are selected so that when the nozzle is at minimum cross-sectional area the nozzle 10 has a tapered portion and the edges of adjacent fingers of both the first and second parts engage one another to close the gap between the fingers and define the smallest nozzle aperture. When the pressure and/or volume of waste material passing through the nozzle 10 exceeds a certain value,, the cross-sectional area of the nozzle 10 increases for example as shown in FIG. 6. In this instance, the force exerted by the tension bands 58 inwardly is now exceeded by the outward force exerted by the fingers 48 as a result of the waste material and an equilibrium position is established. In this way the tapering portion of the nozzle 10 is able to regulate itself in response to variations in the pressure and volume of material passing through the nozzle and other operating conditions as discussed above. An appropriate back pressure for satisfactory compaction can be achieved over a range of operating conditions. Thus when the apparatus is in use, the average operating position of the nozzle 10 is as shown in FIG. 6 with the minimum and maximum operating positions of the nozzle 10 shown in dotted lines for respective decreases and increases in volume and/or pressure of waste material. An appropriate resilient restoring force can be selected in accordance with the expected range of operating conditions when the apparatus is set up by adjusting the number and/or strength of the tension bands. The force is strong e.g. 100 kg for each band. An ejectable plug (not shown) can initially be provided to support the nozzle against this force and prevent the fingers being damaged.

The screw conveyor 4 is supported at one end by a heavy duty bearing 60 and gearbox connected to the drive motor 66. The bearing provides radial location at that end but is principally intended to absorb a high degree of axial thrust which is generated by the screw during compaction. This mounting arrangement permits the longitudinal axis of the screw conveyor to pivot very slightly relative to the longitudinal axis 62 of the passage 6. Thus, if the apparatus 2 is empty the edges of the flight 24 of the screw conveyor 4 in the tapered part 20 of the passage 6 rest on the bottom 63 of that passage as shown in FIG. 1*a*. In practice, the screw conveyor 4 is initially maintained in an axial position in passage 6 by packaging 64 for ease of transport as shown in FIG. 5. When the compactor 2 is first used, the packaging 64 is broken up by the action of the screw conveyor 4 and exits via nozzle 10. Alternatively, the nozzle plug described above may provide the desired initial centering effect.

When the apparatus 2 is in use, the annulus of moving compacted waste material 65 in the compaction chamber 200 of the nozzle 10 acts as a bearing and supports the third part 30 ie. the threadless axial shank of the screw conveyor 4. It has been found that the screw conveyor 4 is centred as well as supported by the waste material in the compaction chamber 200 so that the flight 24 no longer contacts the bottom 63 of the passage 6. Since the waste compactor usually has some waste in the nozzle, even when the compactor is off, the shank 30 is usually supported at both of its ends. It has also been found hat by using waste material as a self-centring bearing, the screw conveyor 4 is able to compensate for wearing of the flight 24 of the screw conveyor as well as for wearing of the tapered passage 20. Furthermore, the bearing 60 need not be as strong as regards the radial location it provides as in comparable prior art arrangements as support is provided at either end of the shank 30.

The axial location of the screw can be adjusted to accommodate for wear by inserting shims of different thickness between shoulders 225.

At the end of the passage 6 adjacent the bearing 60, there is a rear compartment 70. The compartment 70 has a movable flap 71 (see FIGS. 1, 2 and 3) which is biased in a downward direction to prevent material from the hopper 16 from entering that compartment 70. The flap 71 may be of a flexible material which inherently biases the flap towards the closed position. Material can thus only enter the compartment 70 by reverse rotation of the screw conveyor 4 which brings material which is causing a jam from a forward part of the apparatus 2, for example the tapered part 20 of the passage 6, back to the compartment 70.

Coupled to the screw is a tumbling means having a metal blade 72. This blade 72 is made up of a first flexible part 74, which defines a flight, which can be of any suitable material, for example polyurethane. The blade 72 acts against any material brought into the compartment 70 when the screw conveyor 4 is rotating in a reverse direction to tumble and break the material up or increase its volume so that the material can subsequently pass through the apparatus 2 without causing jamming. If necessary, access can be obtained to compartment 70 via flap 71 to remove any offending object therefrom. Alternatively a door (not shown) may be provided in a compartment side wall for the automatic removal of material which cannot be broken up.

The rear chamber is further provided with a raised fluid outlet surface 83 provided with a filtering means and allowing fluid to drain from the apparatus via a drain 80 which is preferably connected to a pump (not shown). With waste having a fluid component, the height of fluid in the base of the apparatus is therefore controlled to the height of the impermeable step 82 provided at the front end of the outlet surface. A controlled degree of self lubrication is therefore provided. Desirably, the resilient part 74 of the tumbling means engages the outlet surface 83 to continually wipe the filtering means clean.

Figure 8:
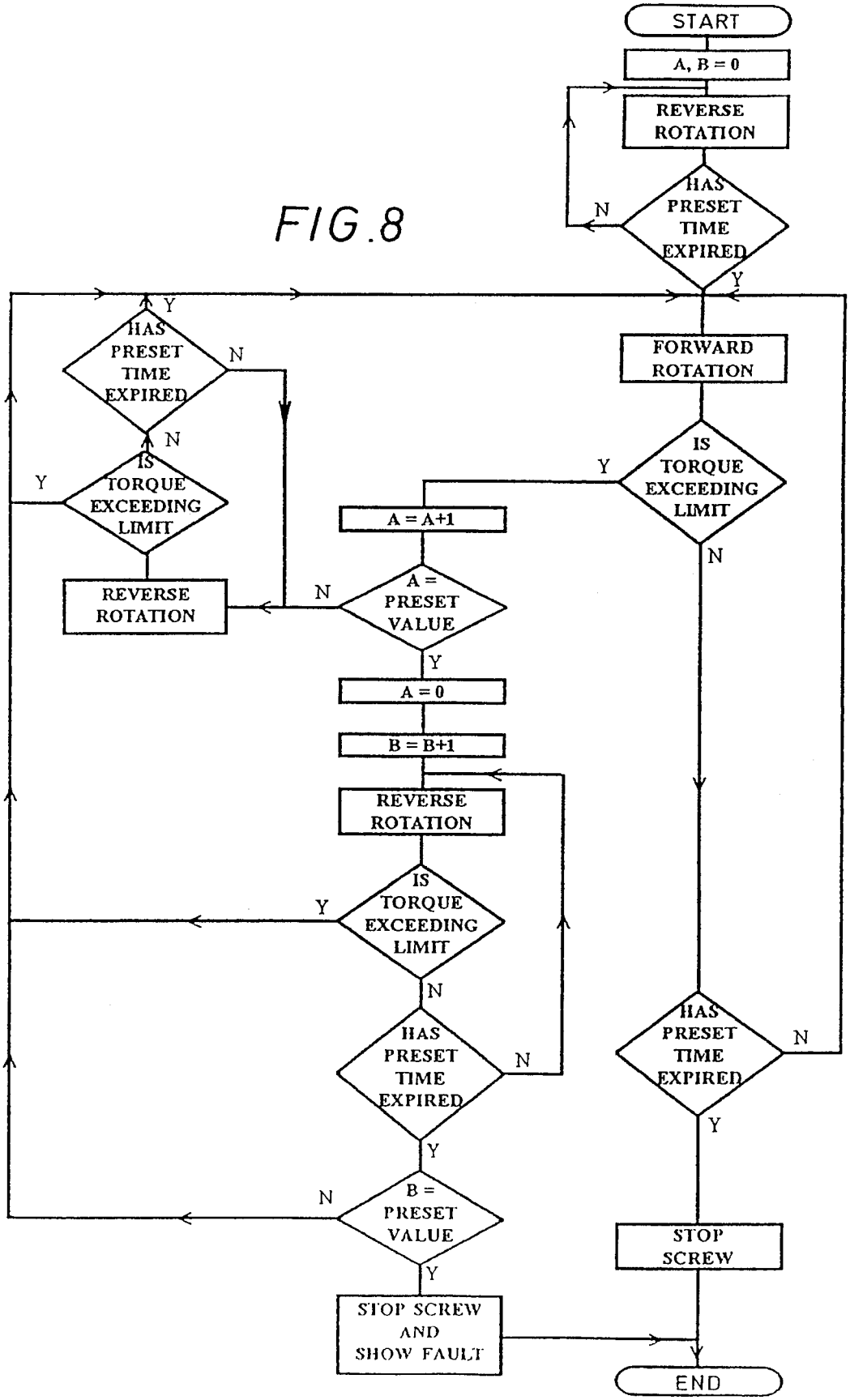
FIG. 8 shows a flow diagram illustrating the control for the screw conveyor.

Operation of the apparatus 2 is controlled by a control circuit (not shown), the function of which is now described with reference to FIG. 8. Initially, when the motor 66 is first started, it rotates the screw conveyor 4 for a short, predetermined period of time in the reverse direction so as to relieve pressure on the screw conveyor, thus preventing the motor 66 from starting under load conditions. The screw conveyor 4 is then driven in the forwards direction.

The control circuit has a sensor (not shown) which detects the amount of current being applied to the motor 66. Since the torque applied to the screw conveyor 4 depends on the current applied to the motor 66, this sensor gives an indication of the torque applied. If the torque applied by the motor 66 exceeds a given value, this is an indication that the screw conveyor 4 is becoming or has become jammed and that the screw conveyor 4 can no longer freely rotate. When this condition is detected, a signal is sent to the motor 66 which causes the motor 66 to stop driving the screw conveyor 4 in the forwards direction and to apply a reverse drive for a predetermined period of time eg. one rotation. The motor 66 then drives the conveyor again in the forwards direction. If the torque applied to the motor 66 still exceeds the given value, then the apparatus is still jamming and the process is repeated until A equals its preset value, e.g. twenty, or the material passes through the conveyor in which case counter A is reset to zero. In practice, it has been found that this repeated backward and forward rotation is often sufficient to break up or adequately reduce the density of the material causing the jam.

However, if the apparatus is still jamming after A has reached its preset value, the screw conveyor is driven in the reverse direction for a sufficient length of time so that the material causing the jam is brought into the rear compartment 70. The screw conveyor 4 is continued to be rotated in the reverse direction for a further predetermined time such that the blade 72 can attempt to break up the jamming material. The motor 66 then drives the screw conveyor 4 in a forward direction so that the material, if broken up, can progressively be picked up by the screw and passed therethrough as before. If however, the material still jams the conveyor, the screw conveyor is again reversed for a number of cycles and the entire above process repeated. The material causing the jam will however only be brought back into the rear compartment a predetermined number of times ie. until B reaches its preset value which for example is 2. After that, the offending material can be taken a final time back into the rear compartment 70, the motor is switched off, and a warning light or alarm activated. The operator is then alerted to the fact that material is to be removed from the rear compartment via flap 71. The operator can remove the material, reset the apparatus and continue compaction. Alternatively, the material can be ejected automatically. It has however been found that in practice there are relatively few objects which can not be processed by the apparatus and which accordingly need to be removed manually from the rear compartment 70.

Additionally, the torque sensor is arranged to detect whether the torque of the screw conveyor when driven in the reverse direction exceeds a given value. If the torque exceeds a given limit, the screw conveyor is then driven in the forward direction.

In the situation where no jamming occurs, the screw conveyor 4 is rotated in the forwards direction for a predetermined time and will only start rotating again when further material is introduced into the hopper 16.

The apparatus 2 has a lid 86 (see FIG. 3) which covers the opening of hopper 16. This lid 86 incorporates a conventional safety contact switch (not shown) which when closed allows the motor to drive the screw conveyor and starts the predetermined period of rotation for the screw conveyor. However, when the contact switch is open and the lid 86 open, no current is supplied to the motor 66 and the screw conveyor 4 does not rotate to ensure the safety of the operator.

A cleaning system 88 is incorporated in the apparatus 2 to allow cleaning. The cleaning system 88 comprises two pipes 90 arranged on opposed walls of the hopper 16. These pipes 90 have a plurality of openings 92 along its length. Water mixed with detergent is then periodically sprayed onto the walls of the hopper 16 to thereby clean it. The hopper 16 is sprayed during use eg. every 15 minutes. Excess water is collected in collecting tray 82 from which it can be drained possibly by a pump (not shown).

Extracting fan 100 is provided in the hopper which allows the contents of the apparatus to be aerated and prevents the build up of noxious odours or dust.

Figure 9:
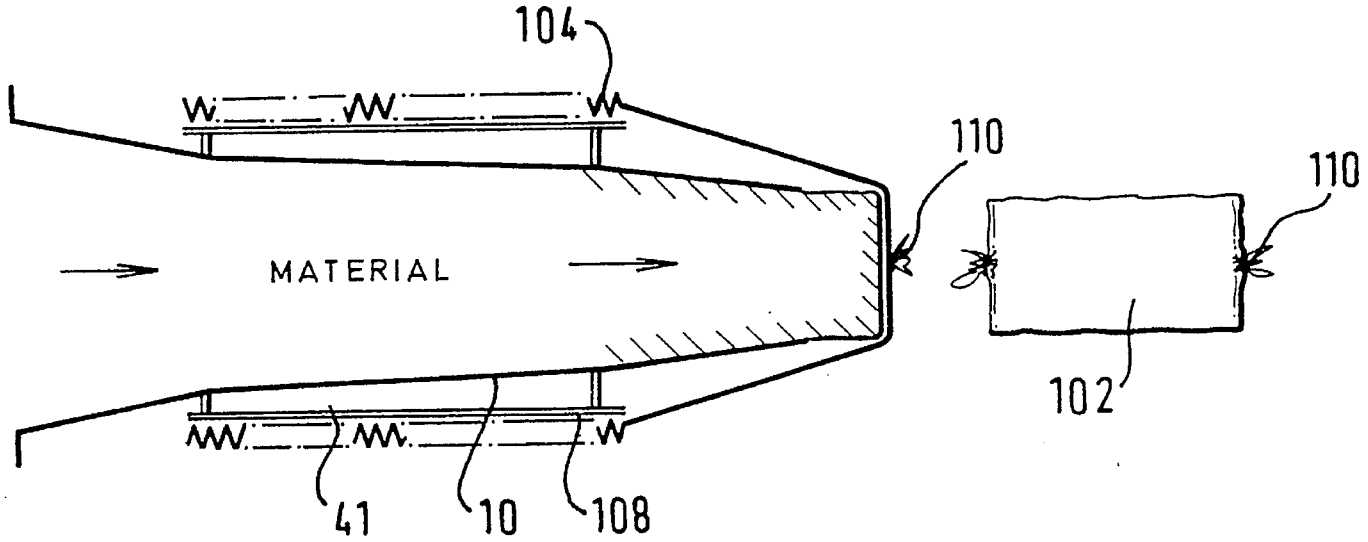
FIG. 9 shows schematically an arrangement for the bagging of material exiting the compactor of FIG. 1.

The material exiting nozzle 10 can be formed into packages 102 such as shown in FIG. 9. A long tube 104 of material, such as tubular plastics packaging, is supported around chamber 41 in an axially contracted state. For example a 30 m length of packaging material can be accommodated on chamber 41. The tube 104 of material is supported by a former 108 which may be of cardboard or any suitable material. The tube 104 of material is closed at its downstream end by a tie 110. As material exits from nozzle 10, it is pushed against the closed end of the tube 104 thereby drawing the packaging material off the former 108 and encapsulating the waste material in the drawn off packaging material. As a result of the compaction to which the material has been subjected, the waste material tends to maintain its sausage like form in which it exits the nozzle. When the package has reached an appropriate length, the tube 104 of packaging material is cut and the ends of the packaging material tied off to form a completely enclosed package 102 which can then be easily disposed of.

An adjustable cutting plate 220 has a cutting edge adjacent the screw at the beginning of its tapering portion for cutting up long items such as wooden poles and the like so that they can be passed through the apparatus. The position of the cutting edge can be adjusted to either increase or decrease the gap between the cutting edge and the screw. The screw itself may be provided with a cutting edge on its periphery to assist the cutting plate 220.

The general operation of the apparatus will now be described with particular reference to FIGS. 2 to 6. The lid 86 is opened and material inserted into the hopper 16. The lid 86 is then closed which enables the operator to start the motor 66 which rotates the screw conveyor. Initial compaction takes place in the tapering portion of the screw, as described above. More substantial compaction takes place in the compaction chamber 200, in the region immediately downstream of the end of the screw conveyor flight. This is due to the back pressure established by the nozzle. The action of the rotating end of the screw is to force material from a lower pressure upstream region to a higher pressure region in the chamber 200. It does this by sweeping out a void space trailing a blunt free end of the screw which space is filled by new material during one rotation to be forced into the compaction chamber by the next. To achieve substantial compaction, the angle of attack of the end of the screw and the thickness of its free end are important and the optimum values can be determined experimentally depending on the type of waste material and degree of compaction desired. In a preferred embodiment, the flight thickness and pitch at the front end of the screw are respectively around 25 mm and around 80° to the longitudinal axis. The compaction mechanism operates by twisting and shearing the waste material and in the preferred embodiment this is such that the material when compacted loses the ability to expand back to its original shape or volume. The total compaction achieved by apparatus embodying the present invention may be in the range of 15 to 60:1 dependent on the type of waste and of course the dimensions of the apparatus.

Figure 6:
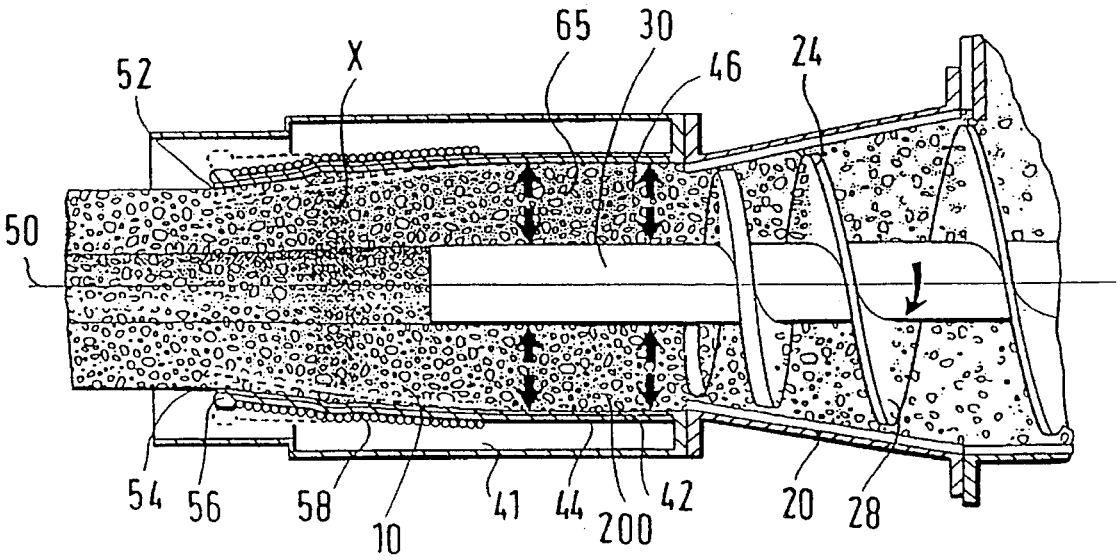
FIG. 6 shows a cross-sectional view of the output end of the compactor of FIG. 1, when filled with waste material.

The region X shown in FIG. 6 indicates that the fingers of the nozzle are preferably sufficiently flexible to conform to a relatively large, incompressible lump of waste being ejected.

The embodiment described above can be modified so as to include a back pressure chamber 114, such as shown in FIG. 10, between the outlet of the passage 6 and the inlet of nozzle 10. Such a back pressure chamber 114 can be used to increase the degree of compaction achieved by the apparatus 2 and therefore constitutes a further compaction chamber. In its simplest form, the chamber 114 is a uniform cylindrical tube of circular cross-section through which the waste material passes. The diameter of the chamber 114 is the same or slightly smaller than that at the outlet end of the passage 6. Accordingly, as material passes through this chamber 114, friction is created between the material and the walls of the chamber 114. This creates a resistance to the movement of the material resulting in a back pressure effect at the outlet 116 of the chamber. The screw conveyor 4 is forced to convey material against this back pressure which results in further compaction.

The back pressure chamber 114 shown in FIG. 10 consists of two portions 118 and 120 which are of approximately the same internal size but which can telescope one within the other to vary the overall length of the chamber 114. Accordingly the total frictional force and the back pressure generated by the chamber 114 can be varied.

A second embodiment of the nozzle will now be described in relation to FIG. 11. Nozzle 130 is formed by two portions 132 and 134 which are each semi-cylindrical. Portion 132 is slightly larger than portion 134 so that the latter portion can, if necessary, be received in the former. The two portions 132 and 134 are pivotally connected to each other at 136, at the end of the nozzle to be attached to the passage 6. The pivot 138 allows the two portions 132 and 134 to move toward or away from each other to thereby vary the cross-sectional area of the nozzle 130. Thus the nozzle has a passage which can taper and which can be adjusted to control the degree of tapering achieved. As with the first embodiment, elastic tensioning bands or springs 140 can be used to urge the two portions 132 and 134 together but to allow the two portions to move away from one another when the volume and/or pressure of material passing through the nozzle 130 exceeds a certain value.

The ribs 22 on the walls of the passage 6 may be resiliently mounted thereon. The ribs 22 could be received in suitably shaped grooves in the walls of the passage with a resilient material such as rubber between the ribs and the back wall of the grooves. Thus the ribs would normally be biased toward a position in which they project to the greatest extent into passage 6. The degree of projection of the ribs would then depend on the volume of material passing through the passage 6. Alternatively, the ribs 22 may be mounted in grooves on the passage wall so that the extent to which they project into the passage 6 can be varied according to the nature of the material being compacted and to compensate for wear. Furthermore, the adjustability of ribs in the grooves allow the arrangement to be adjusted to ensure adequate clearance for the flights of the screw conveyor and prevent the ribs from fouling the screw conveyor.

Whilst the ribs 22 have been shown in the first embodiment as being substantially straight and running along the length of the passage 6, they could be arranged to define a generally helical path.

In addition to the ribs or as an alternative, the inner walls of the passage 6 may be treated so as to increase the friction between the surface of the passage and the material conveyed.

In an alternative embodiment of the invention, the bagging method shown in FIG. 9 is dispensed with and the outlet of the nozzle is connected directed to a waste tube which leads directly to a waste bin. As a result of the compaction to which the waste material is subjected, the sausage of material emerging from the outlet end of the nozzle tends to retain its shape. Accordingly, this material does not tend to stick to the sides of the waste tube leading to the bin, provided that the waste tube has a diameter which is slightly larger than the maximum size of the outlet end of the nozzle.

As will be appreciated, although this apparatus has been described in relation to a use in a fixed installation, it is clear that such apparatus is also suitable for use in vehicles such as refuse collecting vehicles. In such cases, some minor modification to the apparatus would be required. Firstly, a device would be arranged in the upper part of the hopper to force feed the material into the screw conveyor since the waste is typically relatively light and bulky. Secondly, the outlet end of the nozzle would open into a separate compartment of the truck where the compacted waste would be stored. Finally, the back chamber would be arranged to have a trap door which would open when an object was retained therein to drop that object into a further compartment. Thus, continuous operation of the device can be assured.

As can be seen from the illustrated embodiments, the apparatus is preferably made of a large number of parts which can be easily assembled for use. In particular, the first and second parts of the passageway are preferably formed from different components and the extrusion nozzle from yet another. This allows the various parts to be removed, replaced or adjusted for maintenance or as a result of to wear. In certain embodiments it may be appropriate to resiliently mount all adjustable parts of the apparatus so they may be biased towards the position which provides greatest compaction. Excessive compaction will then tend to work against this resilient bias until a state of balance is achieved.

Embodiments of the invention may provide a very high degree of compaction in comparison with conventional techniques. This permits the apparatus to be relatively small when desired. Embodiments of the invention may also have low noise levels and accordingly can be used in locations where such apparatus has not previously been used. The apparatus may be used as a separate device or can be incorporated in equipment which also performs other tasks.

I claim:

1. A compacting apparatus for compacting material passing therethrough, the material exerting pressure on said apparatus during compaction, said apparatus comprising:

passage means for defining a passageway through which a material to be compacted may be conveyed, said passageway having a longitudinal axis and an outlet end;

screw conveyor means at least in part longitudinally disposed within said passageway for conveying material through said passageway at least in a downstream direction toward said outlet end, said conveyor means and said passage means cooperating to compact material passing through said passageway; and nozzle means disposed downstream of said passage means for defining a duct which is in communication with said outlet end of said passageway to allow the material passing through said passageway to exit said outlet end of said passageway and enter said duct defined by said nozzle means, at least a portion of said duct enlarging in response to increasing pressure and contracting in response to decreasing pressure exerted by the material during conveyance through said duct, said nozzle comprising:

inner and outer members, each of said members being coaxially disposed about said longitudinal axis adjacent said outlet end of said passage means and including a plurality of longitudinally extending fingers which terminate at free ends thereof, said fingers of each of members being at least in part radially movable with respect to said axis and arranged such that each pair of adjacent fingers defines a gap therebetween when said nozzle means is in a first position and such that said fingers move relative to one another as said duct enlarges or contracts, said inner member being arranged within said outer member such that said fingers of said members cooperate to define said duct.

2. An apparatus as recited in claim 1, wherein said free ends of said outer member fingers longitudinally extend downstream of said free ends of said inner member fingers.

3. An apparatus as recited in claim 1, further comprising at least one spring, circumferentially disposed about at least a portion of said outer member, said spring urging said fingers of said members radially inwardly.

4. An apparatus as recited in claim 1, further comprising at least one elastic tensioning band disposed about said outer member, said band longitudinally extending along at least a portion of said outer member and urging said fingers of said members radially inwardly.

5. An apparatus as recited in claim 1, further comprising a length of material, said material being wound about said outer member, longitudinally extending along at least a portion of said outer member and urging said fingers of said members radially inwardly.

6. An apparatus as recited in claim 1, further comprising an elastic sleeve disposed about said outer member, longitudinally extending along at least a portion of said outer member and urging said fingers of said members radially inwardly.

7. An apparatus as recited in claim 1, further comprising:

resilient means for urging said fingers of said members radially inwardly, said resilient means being disposed on said nozzle means; and means for retaining said resilient means on said nozzle means.

8. An apparatus as recited in claim 1, wherein said screw conveyor has an inlet end region disposed longitudinally opposite to said outlet end of said passageway, and wherein said apparatus further comprises:

means for rotating said screw conveyor about said longitudinal axis in either a first direction, wherein the material in said passageway is compacted and conveyed in said downstream direction, or a second direction which is opposite to said first direction, wherein the material in said passageway is conveyed in an upstream direction;

sensing means for sensing a jammed condition of said conveyor, said jammed condition occurring when the material passing through said passageway prevents said conveyor from further rotation in said first direction; and a back chamber disposed at said inlet end of said conveyor, said back chamber receiving the jamming material, after said sensing means has sensed said jammed condition and said conveyor has been rotated in said second direction until the jamming material has been conveyed in said upstream direction to said inlet end of said conveyor.

9. An apparatus as recited in claim 1, wherein said passage means includes a tapering region which tapers radially inwardly in said downstream direction, wherein said apparatus further comprises:

rotation means for rotating said screw conveyor about said longitudinal axis in either a first compacting and conveying direction, or a second conveying direction which is opposite to said first direction;

means for sensing a jammed condition of said conveyor, said jammed condition occurring when the material passing through said passageway prevents further rotation of said conveyor in said first direction; and rib means for reducing rotational movement of the material passing through said passageway when said conveyor is rotated in either of said first or second directions, said rib means being disposed in at least said tapered region of said passage means;

said rotation means normally rotating said conveyor in said first direction, said rotation means rotating said conveyor in said second direction through at least a portion of one revolution upon said sensing means sensing said jammed condition, said rotation means thereafter rotating said conveyor in said first direction.

10. An apparatus as recited in claim 1, wherein said passage means includes a base region longitudinally extending from said outlet end in an upstream direction which is opposite to said downstream direction, and wherein said apparatus further comprises means for maintaining a maximum fluid level in said base region of said passage means.

11. An apparatus as recited in claim 1, wherein said duct only enlarges or contracts over a portion thereof which longitudinally extends less than substantially the entire length of said duct.

12. An apparatus as recited in claim 1, wherein said nozzle means tapers radially inwardly in said downstream direction over at least a portion thereof which longitudinally extends less than substantially the entire length of said nozzle means.

13. An apparatus as recited in claim 1, wherein said duct defined by said fingers has a volume which varies between minimum and maximum volumes, and wherein said nozzle means is at least partially formed of a resilient material which causes said nozzle means to be biased toward a second position wherein said duct contracts to said minimum volume.

14. An apparatus as recited in claim 1, wherein said duct defined by said fingers has a volume which varies between minimum and maximum volumes, wherein said nozzle means tapers radially inwardly in said downstream direction over a portion thereof which longitudinally extends over substantially the entire length of said nozzle means, and wherein there are no gaps between said adjacent pairs of fingers of said members and said duct contracts to said minimum volume, when said nozzle means is in a second position.

15. An apparatus as recited in claim 1, wherein said members are arranged such that each finger of one of said members overlaps one of said gaps defined between said adjacent pairs of fingers of the other of said members when said nozzle means is in said first position.

16. An apparatus as recited in claim 1, wherein each of said fingers of said members is flexible over a portion thereof which longitudinally extends over substantially the entire length of said finger.

17. An apparatus as recited in claim 1 further comprising resilient biasing means disposed about said nozzle means, wherein said duct defined by said fingers has a volume which varies between minimum and maximum volumes, and wherein said resilient biasing means urges said nozzle means toward a second position wherein said duct contracts to said minimum volume.

18. An apparatus as recited in claim 1, wherein said screw conveyor has a longitudinally extending shank and a flight with a non-uniform thickness, said thickness of said flight being directly related to the magnitude of the pressure exerted by the material passing through said passageway during compaction.

19. An apparatus as recited in claim 1, wherein said screw conveyor has an inlet end at one end thereof, an outlet end at an opposite end thereof, and an axial shank longitudinally extending from said outlet end of said conveyor, said conveyor being rotatably supported at said inlet end whereby said outlet end of said conveyor may move transversely to said longitudinal axis of said passage means and whereby said shank is surrounded by an annulus of previously compacted material which provides a bearing support therefor.

* * * * *